United States Patent [19]

Moens

[11] 3,936,278

[45] Feb. 3, 1976

[54] REINFORCING ELEMENTS

[75] Inventor: Joris Moens, Kortrijk, Belgium

[73] Assignee: Trefileries Leon Bekaert, P.V.B.A., Zwevegem, Belgium

[22] Filed: Aug. 26, 1968

[21] Appl. No.: 755,312

[30] Foreign Application Priority Data

Aug. 29, 1967 United Kingdom ..... 39540/67

[52] U.S. Cl. ..... 29/193; 52/736

[51] Int. Cl. ..... B21b 15/02

[58] Field of Search ..... 29/193, 193.5; 46/85; 72/371; 52/736, 734; 85/20, 46, 47, 48, 64

[56] References Cited

UNITED STATES PATENTS

| | | | |
|---|---|---|---|
| 402,333 | 4/1889 | Knueppel | 85/47 |
| 441,849 | 12/1890 | Locke et al. | 85/47 |
| 766,280 | 8/1904 | O'Shea | 52/736 |
| 858,693 | 7/1907 | White | 52/736 |
| 949,570 | 2/1910 | Harris | 85/20 |
| 2,352,982 | 7/1944 | Tomalis | 85/47 |

FOREIGN PATENTS OR APPLICATIONS

| | | | |
|---|---|---|---|
| 4,632 | 2/1898 | United Kingdom | 52/736 |

OTHER PUBLICATIONS

Abrams, *Tests of Bond Between concrete and Steel," Univ. of Ill., Eng. Expt. Station Bulletins, 1913, pp. 61, 72, 73, and explanatory letter (1943) attached.*

*Primary Examiner*—A. B. Curtis
*Assistant Examiner*—O. E. Crutchfield

[57] ABSTRACT

Article incorporating at least one tensile reinforcing element such as a metal ribbon twisted in helical fashion but having at least one edge thereof intermittently deformed out of its helical configuration.

6 Claims, 6 Drawing Figures

INVENTOR
JORIS MOENS
BY
SPARROW and SPARROW
ATTORNEYS

REINFORCING ELEMENTS

BACKGROUND OF THE INVENTION

This invention relates to the reinforcement of articles of a kind having the general characteristic that reinforcing strand elements may be incorporated therein during the manufacture of such articles or of their constituent materials, for example by embedding such strand elements in the material if its manufacture involves a molding step, or by incorporating such elements between layers of a laminated material. The invention is thus applicable to the reinforcement of articles made of materials of the most varied kinds, such as for example concrete, plastics, rubber in either molded or laminated sheet form, and fabricated sheet material of the nature of hardboard, chipboard and laminated board. Articles of this kind are those hereinafter referred to as being of the kind described.

It is wellknown to reinforce such articles against the effects of tension by means of metal strands incorporated therein. In a simple form such strands can be metal ribbons or cylindrical wires. The reinforcing effect of a metal ribbon is however substantially increased if, as is also known, it is twisted either about itself or about an imaginary cylinder so that the edges thereof follow respective helical paths which are of equal diameter if the ribbon is twisted about itself or of diameters which differ by approximately the width of the ribbon if it is twisted about an imaginary cylinder. However, the increased reinforcing effect obtained by employing such a twisted metal ribbon is somewhat offset by the fact that a screw effect is thereby introduced when the reinforced material is in tension which tends in time to loosen the engagement between the reinforcing strand and the surrounding material. The present invention provides a reinforced article in which the latter disadvantage is overcome or substantially reduced.

SUMMARY OF THE INVENTION

Viewed from a broad aspect the invention provides an article of the kind described, which article incorporates at least one tensile reinforcing element, such element comprising a metal ribbon twisted in helical fashion but shaping at least one edge thereof intermittently deformed out of its helical configuration.

The reinforcing ribbon or ribbons may if desired be prestressed before their incorporation in the said article or in the constituent material thereof. Where a number of reinforcing ribbons are present these may be disposed in a predetermined alignment or in random fashion, as desired. The lengths of the ribbons may vary substantially, i.e. from less than an inch upwards to lengths commensurate with the dimensions of the article concerned.

The said intermittent deformation of at least one edge of the twisted ribbon out of its helical configuration destroys the aforementioned screw effect which previously tended to weaken the gripping engagement between such a ribbon and its surrounding material. The desired deformation may most conveniently be achieved by passing the helically twisted ribbon through the nip of a pair of rollers before it is incorporated in the article to be reinforced, so that at least one edge of the ribbon is flattened at successive regions spaced by one complete turn of the helix.

It will be understood that if the ribbon is one which has been twisted about itself its passage through rollers as mentioned above will result in both of its edges being so intermittently deformed; if on the other hand the ribbon is one which is twisted about an imaginary cylinder, and which will in fact have been so formed by twisting it about a cylindrical mandrel, the twisted ribbon will be passed through the rollers while still mounted on such mandrel and only the outer edge of the ribbon will thereby be intermittently flattened.

It will be further understood that if the twisted ribbon is deformed by passing it through the nip of a pair of rollers as aforesaid its thickness/width ratio must be such as to prevent its buckling rather than simply being flattened on its edges as desired; it has been found that a thickness/width ratio of about 1:4 produces satisfactory results. The possibility of buckling may be reduced by deforming the ribbon in two stages, e.g. by passing it through two successive pairs of rollers.

The degree of deformation that may be applied to the twisted ribbon is also limited by certain factors, because such deformation despite its aforementioned advantages also tends to reduce that helical nature of the twisted ribbon which improves its reinforcing qualities as compared with those of an untwisted ribbon of the same dimensions. We have found that a degree of deformation which, in the deformed regions of a ribbon which has been twisted on itself, reduces its overall diameter by about two-fifths produces a satisfactory result.

When the ribbon is deformed by passing it through the nip of one or more pairs of rollers the surfaces of the latter may be cylindrical as is preferred or of outwardly concave shape, i.e. waisted.

If desired the stresses set up in the twisted and deformed ribbon in its manufacture may be relieved by heat treatment of the ribbon.

The invention also extends to a reinforcing ribbon alone and thus, viewed from another aspect, provides a tensile reinforcing element for incorporation in an article of the kind described, comprising a metal ribbon twisted in helical fashion but having at least one edge thereof deformed out of its helical configuration at regularly spaced regions along the length thereof.

It should be understood that although a very convenient way of deforming a twisted ribbon according to the invention is by passing it through the nip of one or more pairs of rollers the edge or edges of the ribbon may be deformed in many other ways, so long as the basic desideratum of intermittently breaking the helical configuration of such edge or edges is met so as to destroy the aforementioned screw effect. Thus for example the ribbon may be passed through a press which will stamp flats on its edge or edges either at every helical turn or in spaced groups of such turns, or through a pair of indented rollers which will engage it intermittently so as to deform the ribbon at every second or third helical turn thereof, for example. In another alternative a series of notches could be cut in the edge or edges of the ribbon at spaced intervals therealong.

Two or more twisted and deformed ribbons according to the invention may if desired be twisted together to form a composite reinforcing strand.

We have found that, while the adhesion in tension between a twisted but undeformed ribbon and its surrounding material is approximately four times as great as if an untwisted ribbon is used, the adhesion in the case of a twisted and deformed ribbon according to the invention is approximately five times as great again as in the case of twisted but undeformed ribbon.

It will be understood that any desired number of reinforcing ribbons according to the invention may be incorporated in a material in any desired arrangement relative to one another, for example, in parallel relationship or so as to form a regular or irregular lattice, depending on design requirements.

Various specific purposes, features and advantages will clearly appear from the detailed description given below taken in connection with the accompanying drawing which forms part of this specification and illustrate merely by way of examples certain embodiments of the barbed wire according to the invention.

BRIEF DESCRIPTION OF THE DRAWING

In the following description and in the claims, parts will be identified by specific names for convenience, but such names are intended to be as generic in their application to similar parts as the art will permit. Like reference characters denote like parts in the several figures of the drawing, in which:

In order that the invention may be more readily understood certain embodiments of tensile reinforcing elements according to the invention will now be described by way of example and referring first to FIGS. 1 and 2, there is shown a portion of steel ribbon 1 which is helically twisted about itself. The twisted ribbon is formed at spaced intervals, i.e. one in every helical turn, with mutually opposite flat surfaces 2 impressed on edges of the twisted ribbon.

Figure 1:
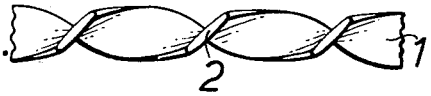
FIGS. 1 and 2 are a plan and side elevation respectively of part of a first embodiment of a reinforcing element according to the invention.
Figure 2:
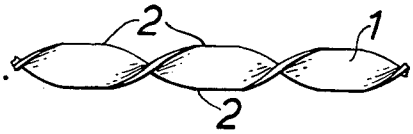
Figure 3:
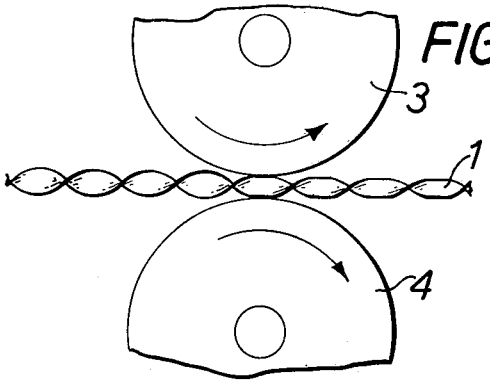
FIGS. 3 and 4 illustrates two alternative ways of forming the element of FIGS. 1 and 2.
Figure 4:
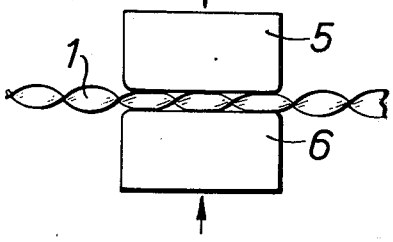

The twisted ribbon of FIGS. 1 and 2 may be flattened by passing it through the nip of a pair of rollers 3 and 4, as shown in FIG. 3. An alternative way of flattening the ribbon is by passing it step-wise through a press, as shown in FIG. 4, having jaws 5 and 6 between which spaced regions of the edges of the twisted ribbon are flattened.

Figure 5:
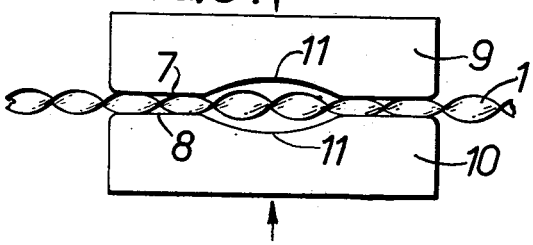
FIGS. 5 and 6 illustrate the manners of forming three other embodiments of reinforcing elements according to the invention.

FIG. 5 illustrates another form of press, in which the faces 7 and 8 of jaws 9 and 10 are each provided with a concave portion 11. It is evident that by this method every other two consecutive helical turns of the twisted ribbon 1 will be flattened, so forming a somewhat modified element.

Figure 6:
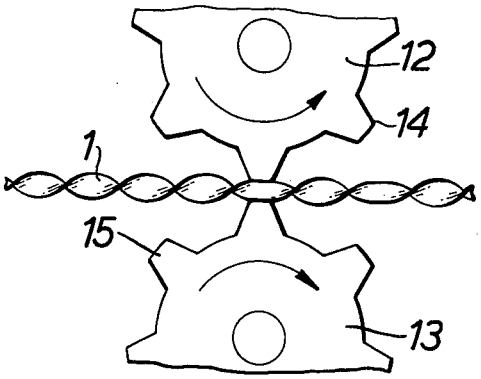

FIG. 6 illustrates another method of flattening the twisted ribbon 1. In this instance a pair of rollers 12 and 13 are formed with complementary teeth 14 and 15. As the rollers rotate the twisted ribbon is flattened by being nipped between their teeth. In this particular embodiment alternate helical turns of the ribbon are flattened, but clearly every turn could be flattened if the teeth were spaced more closely on the respective rollers.

In a preferred form of the invention the reinforcing element comprises a steel ribbon having a width of 0.5 mm. and a thickness of 0.125 mm. which has been helically twisted about itself so as to have a pitch of about 1.25 mm. The twisted ribbon has then been passed through the nip of a pair of cylindrical rollers spaced from one another by 0.3 mm. so that, once in each turn of the helically twisted ribbon, the width thereof has been reduced by compression and flattening of its opposite edges to 0.3. mm. In this way the two similar helices followed by the respective edges of the ribbon have been intermittently broken by a flattened portion of such edge having a length of about 0.5 mm. Thus, the screw-like configuration of the ribbon which is incorporated in the material to be reinforced, enables the surrounding material, as a result of its molding or compression about the ribbon, to closely follow the lines of the edges of the ribbon with the result that material and ribbon will grip one another tightly.

If desired the twisted and deformed ribbon may be provided with a non-ferrous, or indeed non-metallic, coating to inhibit corrosion thereof.

While the invention has been described and illustrated with respect to certain preferred examples which give satisfactory results, it will be understood by those skilled in the art after understanding the principle of the invention, that various changes and modifications may be made without departing from the spirit and scope of the invention and it is intended therefor in the appended claims to cover all such changes and modifications.

What is claimed is;

1. A tensile reinforcing element for molded or laminated articles consisting of a metal ribbon of rectangular cross section uniformly twisted into a helix along the longitudinal centerline of said ribbon, and a plurality of flattened areas uniformly spaced on at least one edge of said helically twisted ribbon along the length of said ribbon so as to deform the otherwise helically curved edge of said ribbon.

2. A tensile reinforcing element according to claim 1, wherein both of its helical edges are flattened at regions which lie opposite one another across the width of the ribbon.

3. A tensile reinforcing element according to claim 2, wherein the edges are each flattened once in each helical revolution.

4. A tensile reinforcing element according to claim 1, wherein the edge is flattened so that the overall diameter of the helix is reduced by substantially 2/5 in its flattened regions.

5. A tensile reinforcing element according to claim 1, wherein the thickness/width ratio of the rectangular cross section of the ribbon is about 1:4.

6. A tensile reinforcing element according to claim 1, said ribbon being formed of steel and having an anticorrosive coating.

* * * * *